US011284203B2

(12) United States Patent
Williamson et al.

(10) Patent No.: US 11,284,203 B2
(45) Date of Patent: Mar. 22, 2022

(54) MICROPHONE ARRAY ASSEMBLY

(71) Applicant: Logitech Europe S.A., Lausanne (CH)

(72) Inventors: Clayton Christopher Williamson, Moorpark, CA (US); Adam Kirk Bennett, Ventura, CA (US); Matthew Fumio Yamamoto, Moorpark, CA (US); Sal Gregory Garcia, Camarillo, CA (US); Tyler Copeland Barkley, Simi Valley, CA (US); Aaron Lee Butters, Thousand Oaks, CA (US)

(73) Assignee: LOGITECH EUROPE S.A., Lausanne (CH)

( * ) Notice: Subject to any disclaimer, the term of this patent is extended or adjusted under 35 U.S.C. 154(b) by 0 days.

(21) Appl. No.: 17/009,583

(22) Filed: Sep. 1, 2020

(65) Prior Publication Data

US 2021/0099809 A1 Apr. 1, 2021

Related U.S. Application Data

(60) Provisional application No. 62/908,412, filed on Sep. 30, 2019.

(51) Int. Cl.
*H04R 19/04* (2006.01)
*H04R 1/04* (2006.01)

(52) U.S. Cl.
CPC ..... *H04R 19/04* (2013.01); *H04R 1/04* (2013.01); *H04R 2201/025* (2013.01)

(58) Field of Classification Search
CPC ..... H04R 19/04; H04R 2410/01
See application file for complete search history.

(56) References Cited

U.S. PATENT DOCUMENTS

| | | | | |
|---|---|---|---|---|
| 4,042,779 | A * | 8/1977 | Craven | H04R 5/027 381/103 |
| D504,126 | S | 4/2005 | Saulespurens et al. | |
| D551,661 | S | 9/2007 | Probst et al. | |
| D563,396 | S | 3/2008 | Probst et al. | |
| D570,821 | S | 6/2008 | Probst et al. | |
| D586,335 | S | 2/2009 | Wise et al. | |
| D594,855 | S | 6/2009 | Metlen et al. | |
| D599,786 | S | 9/2009 | Metlen et al. | |
| 8,588,433 | B2 | 11/2013 | Saulespurens et al. | |
| D729,778 | S | 5/2015 | Langis et al. | |
| 9,679,551 | B1 | 6/2017 | Wiggins et al. | |

(Continued)

*Primary Examiner* — Sunita Joshi
(74) *Attorney, Agent, or Firm* — Patterson & Sheridan, LLP

(57) ABSTRACT

A microphone capsule assembly includes a first microphone capsule oriented to face a first direction that is parallel to a first plane, a second microphone capsule oriented to face in a direction opposite to the first direction, where a front face of the second microphone capsule is spaced a distance from a front face of the first microphone capsule in the first direction, a third microphone capsule oriented to face in a second direction that is at a first acute angle to the first direction when measured parallel to the first plane, and a fourth microphone capsule oriented to face in a third direction that is at a second acute angle to the first direction when measured parallel to the first plane, where the third and fourth microphone capsules are spaced a distance from the front face of the first microphone capsule in the first direction.

21 Claims, 6 Drawing Sheets

(56) References Cited

U.S. PATENT DOCUMENTS

| | | | | |
|---|---|---|---|---|
| D826,908 | S | 8/2018 | Stillerman et al. | |
| 2010/0142732 | A1* | 6/2010 | Craven | H04S 3/00 381/170 |
| 2012/0014535 | A1* | 1/2012 | Oouchi | H04R 3/005 381/92 |
| 2017/0002650 | A1 | 9/2017 | Wiggins et al. | |

* cited by examiner

MICROPHONE ARRAY ASSEMBLY

CROSS-REFERENCE TO RELATED APPLICATIONS

This application claims priority under 35 U.S.C. § 119 (e) to U.S. Provisional Application No. 62/908,412, filed Sep. 30, 2019, which is incorporated by reference herein.

BACKGROUND

Field

Embodiments of the present disclosure generally relate to a microphone capsule assembly and a microphone system.

Description of the Related Art

A stereo microphone commonly includes two microphone capsules arranged in a vertically stacked configuration such that the capsules are oriented typically at an angle of 90° relative to each other (45° to either side of a center line that faces an audio source) (referred to as "X-Y technique" or "X-Y stereo setup"). To avoid any phase difference in received audible signal(s), due to the distance between the two microphone capsules and the audible signal source, the two microphone capsules are stacked vertically such that diaphragms of the two microphone capsules are vertically aligned. In this way, audible sounds transmitted in a direction parallel to the horizontal plane are received coincidently.

However, the vertical distance between the two microphone capsules generates a noisy signal due to phase differences in audible sound that is received after being reflected by various external components, for example, a table on which the microphone is located. Furthermore, since the diaphragms of the two microphone capsules are disposed adjacent to each other, sound from an audio source entering one of the two microphone capsules can be disturbed by the other capsule, causing additional noise in the signal generated by each of the capsules.

Therefore, there is a need for an improved microphone system that overcomes the deficiencies described above.

SUMMARY

Embodiments of the disclosure provide a microphone capsule assembly that includes a first microphone capsule disposed in a first plane and oriented forward in a first direction that is parallel to the first plane, a second microphone capsule disposed in the first plane and oriented in a direction opposite to the first direction, where the second microphone capsule is spaced a distance from the first microphone capsule in the first direction, a third microphone capsule disposed in a second plane that is parallel to and spaced a distance from the first plane and orientated in a second direction that is parallel to the second plane, and a fourth microphone capsule spaced from the third microphone capsule in the second plane and oriented in a third direction that is parallel to the second plane, wherein the third and fourth microphone capsules are positioned a distance from the first microphone capsule in the first direction.

Embodiments of the disclosure further provide a microphone capsule assembly, comprising a first microphone capsule oriented to face a first direction that is parallel to a first plane, a second microphone capsule oriented to face in a direction opposite to the first direction, wherein a front face of the second microphone capsule is spaced a distance from a front face of the first microphone capsule in the first direction, a third microphone capsule oriented to face in a second direction that is at a first acute angle to the first direction when measured parallel to the first plane, and a fourth microphone capsule oriented to face in a third direction that is at a second acute angle to the first direction when measured parallel to the first plane, wherein the third and fourth microphone capsules are spaced a distance from the front face of the first microphone capsule in the first direction.

Embodiments of the disclosure further provide a microphone capsule assembly, comprising a first pair of microphone capsules disposed in a first plane, a second pair of microphone capsules disposed in a second plane that is parallel to and spaced a distance from the first plane, wherein the first pair of microphone capsules comprises a first microphone capsule oriented to face in a first direction that is parallel to the first plane, and a second microphone capsule oriented to face in a direction that is opposite to the first direction, and a front face of the second microphone capsule is spaced a distance from a front face of the first microphone capsule in the first direction, the second pair of microphone capsules comprises a third microphone capsule oriented to face in a second direction that is at a first acute angle to the first direction when measured parallel to the second plane, and a fourth microphone capsule spaced a distance from the third microphone capsule in the second plane and oriented to face in a third direction that is at a second acute angle when measured parallel to the second plane and perpendicular to the second direction. In some embodiments, the first direction bisects an angle formed between the second and third directions.

Embodiments of the disclosure further provide a microphone capsule assembly, comprising a first microphone capsule disposed on a first plane and oriented to face in a first direction that is at a first acute angle to a second direction when measured parallel to the first plane, and a second microphone capsule disposed on the first plane and oriented to face in a third direction that is at a second acute angle to the second direction when measured parallel to the first plane.

Embodiments of the disclosure further provide a microphone capsule assembly, comprising a first microphone capsule oriented to face a first direction that is parallel to a first plane, and a second microphone capsule oriented to face in a direction opposite to the first direction, wherein a front face of the second microphone capsule is spaced a distance from a front face of the first microphone capsule in the first direction.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, and may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present disclosure generally relate to a microphone capsule assembly that includes a first microphone capsule disposed in a first plane and oriented in a first direction that is parallel to the first plane, a second microphone capsule disposed in the first plane and oriented in a direction that is opposite to the first direction, where the second microphone capsule is spaced a distance from the first microphone capsule in the first direction, a third microphone capsule disposed in a second plane that is parallel to and spaced a distance from the first plane and orientated in a second direction that is parallel to the second plane, and a fourth microphone capsule spaced from the third microphone capsule in the second plane and oriented in a third direction that is parallel to the second plane, wherein the third and fourth microphone capsules are positioned from the first microphone capsule in the first direction.

The following disclosure includes embodiments that can improve response to audio signals received from an audio source by a microphone system that includes a desirable arrangement of microphone capsules. Advantages of the microphone system(s) disclosed herein include the reduction in noise due to phase differences created in conventional microphone configurations in which audible sounds generated by audio sources are reflected by external components and the conventional microphone capsules themselves.

Figure 1A:
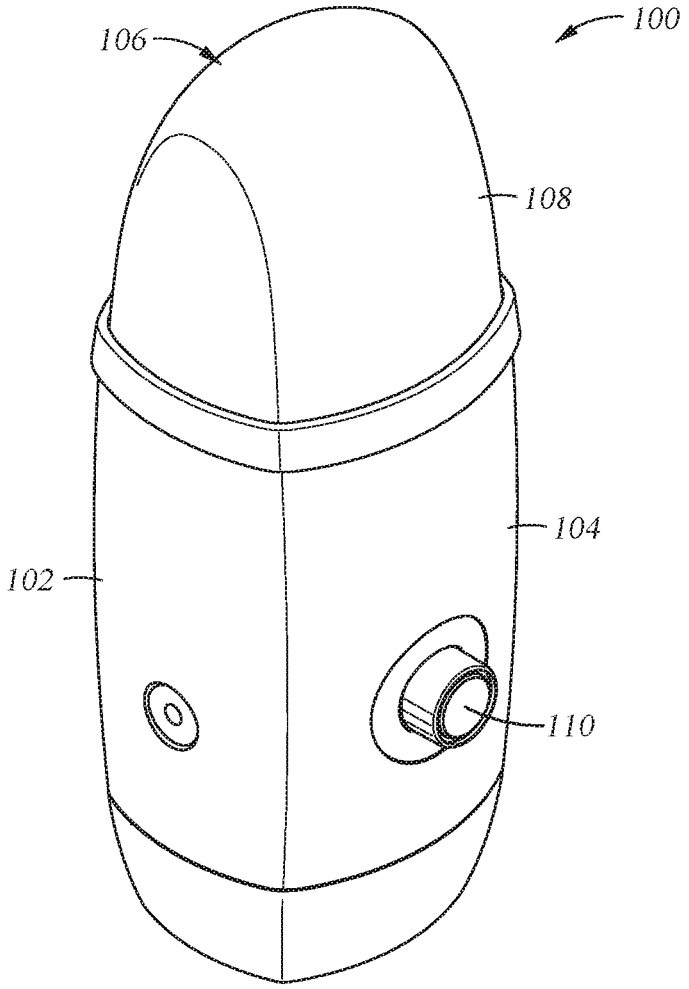
FIG. 1A is a perspective view of a microphone system according to one embodiment.
Figure 1B:
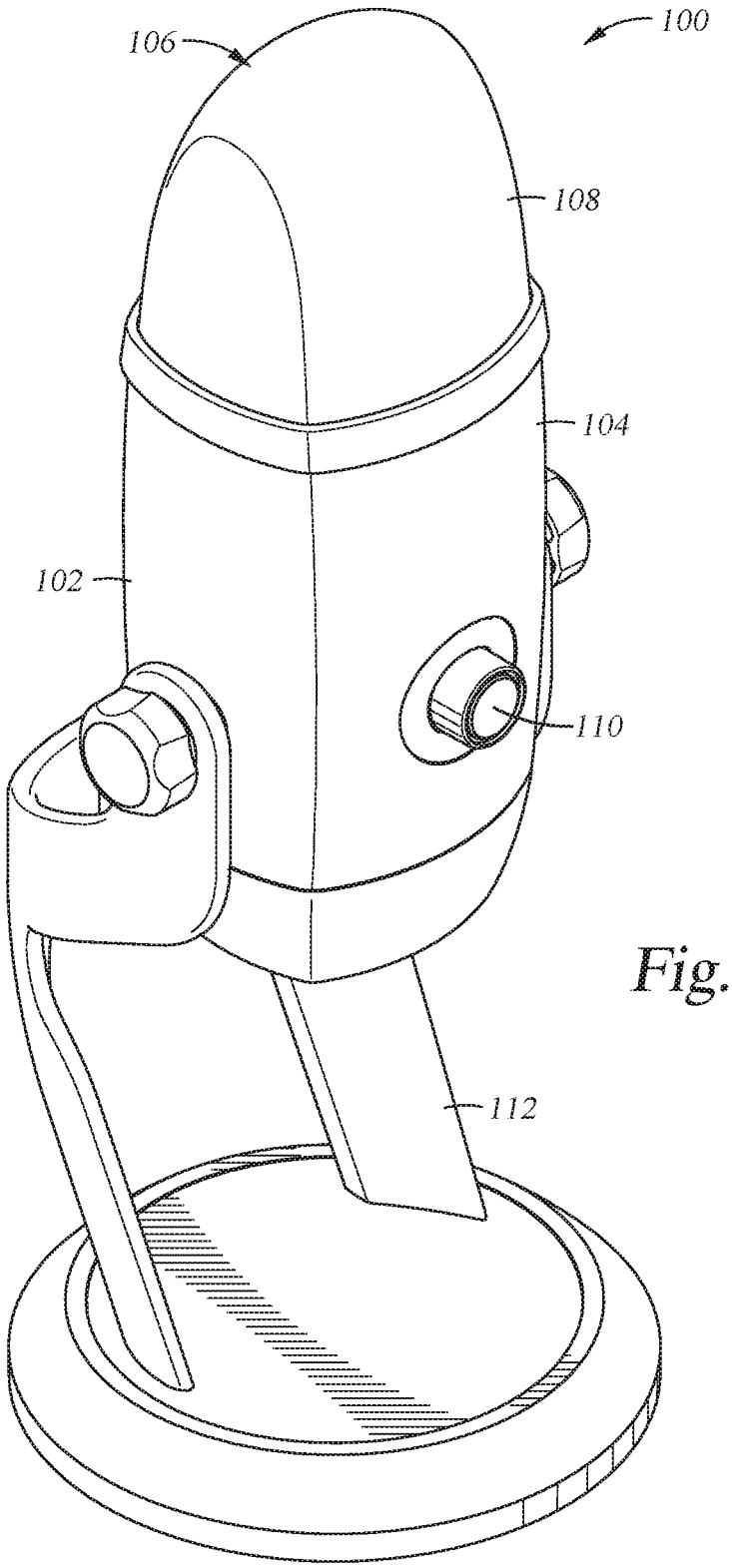
FIG. 1B is a perspective view of a microphone system on a stand according to one embodiment.

FIG. 1A is a perspective view of a microphone system 100 according to one embodiment. The microphone system 100 includes a housing 102 and a microphone capsule assembly 200 (illustrated in FIG. 2) encased within the housing 102. The housing 102 includes a body 104 and a cover 106. The microphone capsule assembly 200 is disposed on the body 104 and under the cover 106. The microphone system 100 can be placed such that a front face 108 is oriented substantially towards a desired audio source. The cover 106 is acoustically transparent such that audible signals that pass through the cover 106 maintain acoustic fidelity to the microphone capsule assembly 200 inside the cover 106. The microphone system 100 further includes a switch 110 that allows a user to configure various features of the microphone system 100. In some embodiments, the microphone system 100 is supported by a stand 112 as shown in FIG. 1B.

Figure 1C:
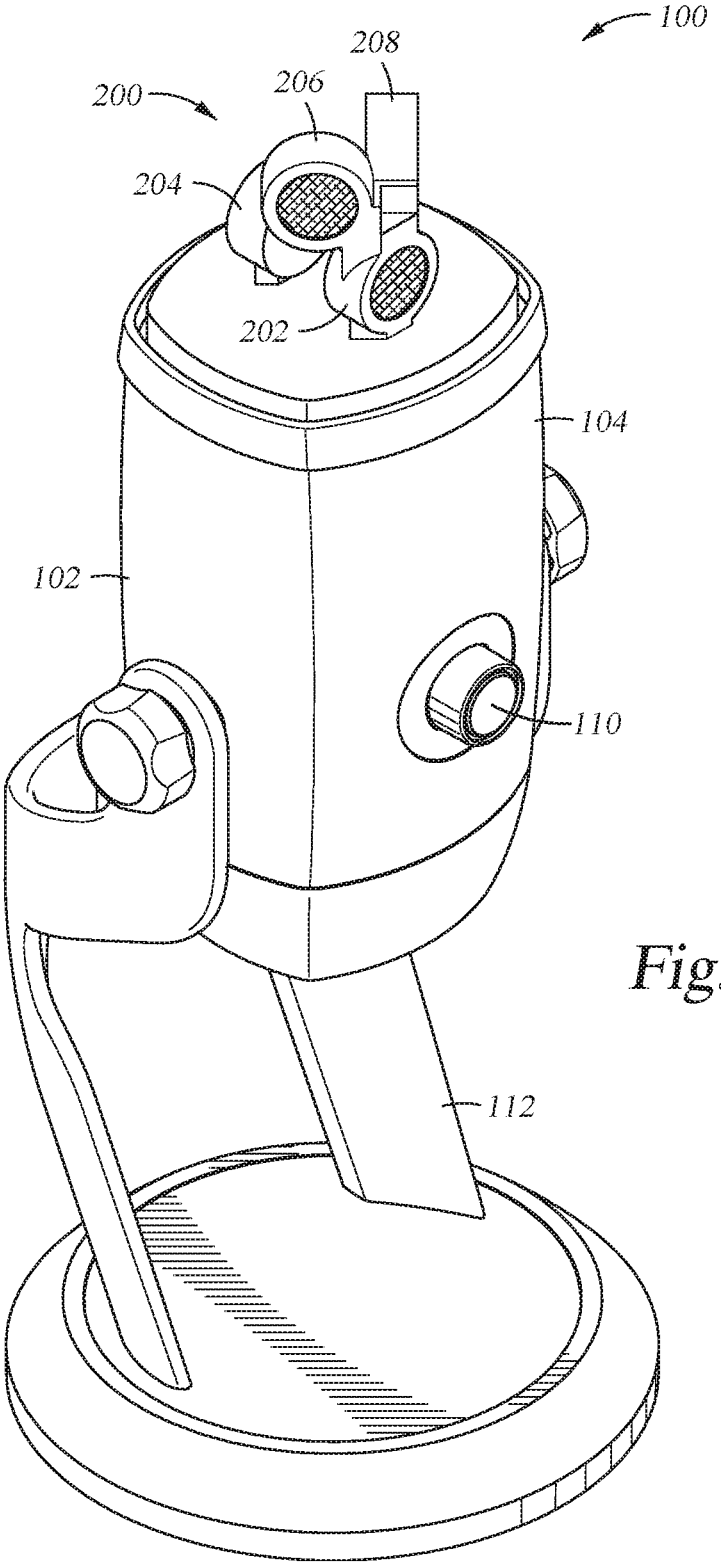
FIG. 1C illustrates the microphone system illustrated in FIG. 1B with a cover removed.
Figure 2A:
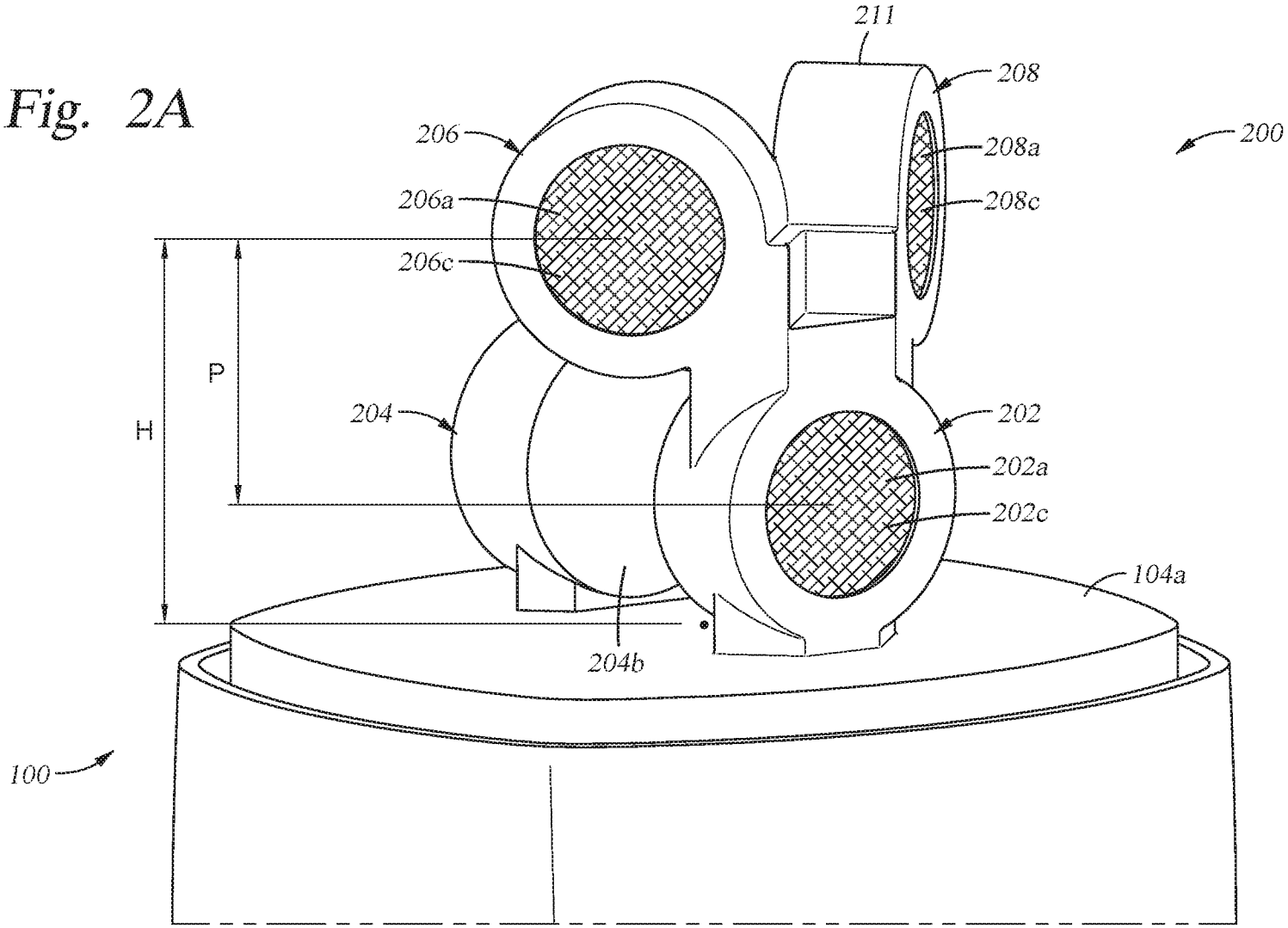
FIGS. 2A and 2B are a perspective view and a top view of a microphone capsule assembly according to one embodiment.
Figure 2B:
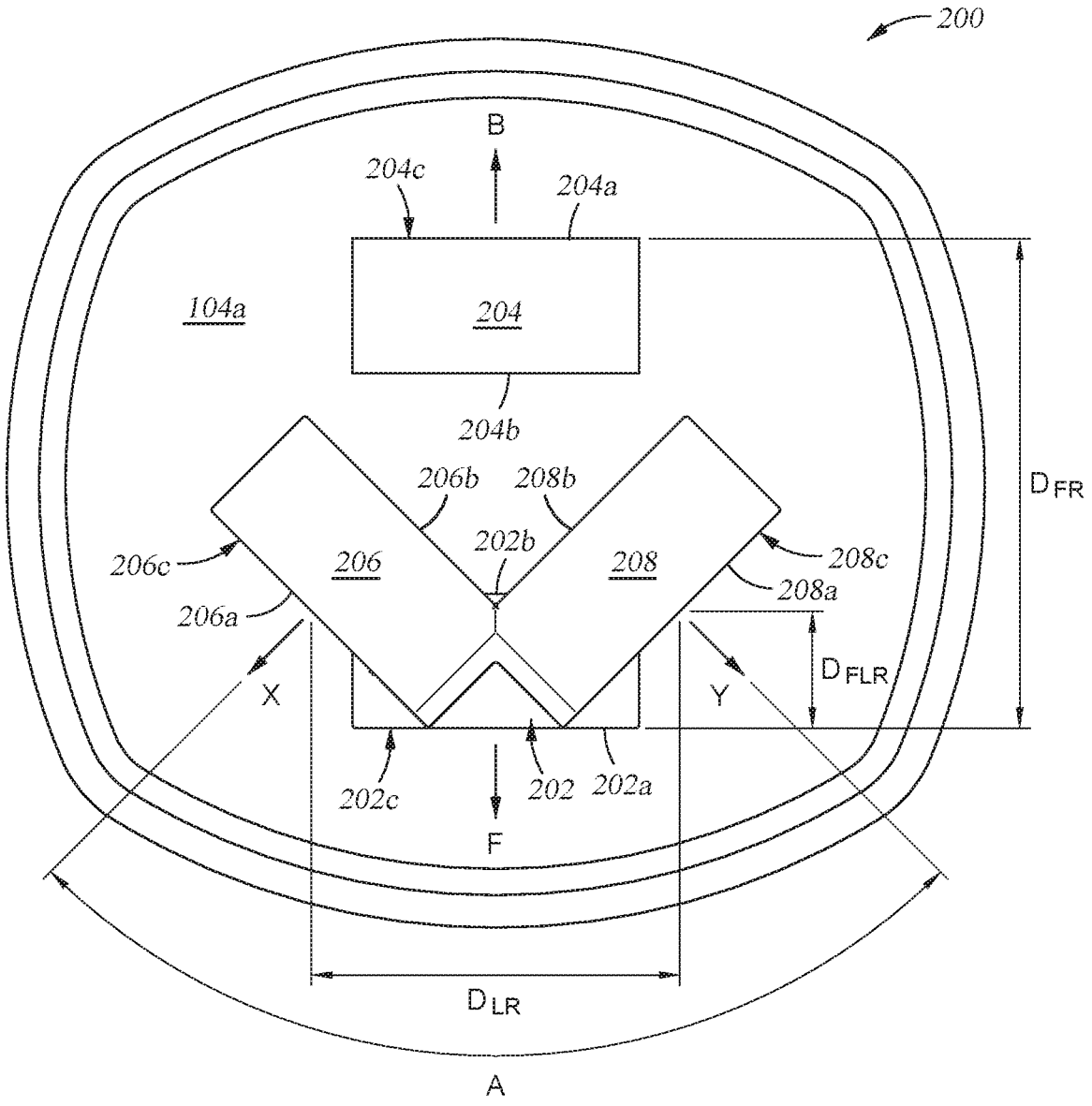

FIG. 1C is a perspective view of a microphone system 100 with the cover 106 removed to expose a microphone capsule assembly 200. The microphone capsule assembly 200 is enclosed within an internal space defined by the cover 106 and the body 104 when the cover 106 is positioned on the body 104. FIGS. 2A and 2B include a close up perspective view and a close up top view of the microphone capsule assembly 200 illustrated in FIG. 1C, according to one embodiment. In FIGS. 2A and 2B, the microphone system 100 is also illustrated with the cover 106 removed.

In one embodiment, the microphone capsule assembly 200 includes four cardioid condenser microphone capsules. Typically, the microphone capsules include a front face that is positioned parallel to a diaphragm, or membrane, and perpendicular to the axis of motion of a diaphragm or the deformation direction of the membrane in response to a received audible input signal (e.g., sound generated from a source). In one configuration, the microphone capsules in the microphone capsule assembly 200 are 14 millimeters (mm) diameter microphone capsules. The microphone capsule assembly 200 illustrated in FIGS. 2A and 2B include a front microphone capsule 202, a rear microphone capsule 204, a left microphone capsule 206, and a right microphone capsule 208. The front microphone capsule 202 is disposed on a top surface 104*a* of the body 104 and is oriented so that a front face 202*c* is oriented in a forward direction "F" (illustrated in FIG. 2B). The forward direction "F" is parallel to a first plane that is parallel to the top surface 104*a* of the body 104, and a diaphragm 202*a* of the front microphone capsule 202 faces the direction "F." In one configuration of the front microphone capsule 202, the front microphone capsule includes a backside 202*b*, which is opposite to the diaphragm 202*a*, that is sealed. In one embodiment, the front microphone capsule 202, the left microphone capsule 206, and the right microphone capsule 208 are positioned within and supported by a support element 211. In one embodiment, the rear microphone capsule 204 is positioned within and supported by a support element 212. The support element 211 is formed from a polymer material, such as silicone rubber that has a durometer of between about 20 and 30 on a Shore A scale, such as about 25 on a Shore A scale. The support element 212 is formed from a polymer material, such as silicone that has a durometer of between about 50 and 60 on a Shore A scale, such as about 55 on a Shore A scale. In one configuration, the front microphone capsule 202, the left microphone capsule 206 and the right microphone capsule 208 are mounted in the support element 211 that includes a first material that has a durometer of less than about 30 on a Shore A scale and the rear microphone capsule 204 is mounted in the support element 212 that includes a second material that has a durometer greater than the durometer of the first material.

The rear microphone capsule 204 is disposed on the top surface 104*a* of the body 104 and is oriented so that a front face 204*c* is oriented to face a direction "B" (illustrated in FIG. 2B). The backward direction "B" is parallel to the first plane that is parallel to the top surface 104*a* of the body 104 and opposite of the direction "F" (i.e., the angle between the directions "F" and "B" is 180°, or direction "B" is oriented in a negative forward direction where direction "F" is a positive forward direction). A diaphragm 204*a* of the rear microphone capsule 204 faces in the direction "B." In one configuration of the rear microphone capsule 204, the rear microphone capsule includes a backside 204*b*, which is opposite to the diaphragm 204*a*, that is sealed. The rear microphone capsule 204 is spaced from the front microphone capsule 202 in the backward direction "B." A distance "$D_{FR}$" between the front face 202*a* of the front microphone capsule 202 and the front face 204*c* of the rear microphone capsule 204 is between about 30 mm and about 40 mm, such as about 37 mm. In some configurations, the front microphone capsule 202 and the rear microphone capsule 204 are positioned in the same plane (e.g., co-planar), such as the first plane. In some embodiments, the front microphone capsule 202 and the rear microphone capsule 204 are each configured to operate in a perpendicular orientation to the plane that they share.

The left microphone capsule 206 and the right microphone capsule 208 are disposed in an elevated plane that is parallel to the top surface 104*a* of the body 104, and parallel to a plane containing the front and rear microphone capsules. Within the elevated plane, the left microphone capsule 206 is oriented so that a front face 206*c* is oriented in a direction "X" (illustrated in FIG. 2B) (i.e., a diaphragm 206*a* of the left microphone capsule 206 faces in the direction "X"). Within the same elevated plane, the right microphone capsule 208 is oriented so that a front face 208*c* is oriented in a direction "Y" (illustrated in FIG. 2B) (i.e., a diaphragm 208*a* of the right microphone capsule 208 faces in the direction "Y"). The direction "Y" is oriented at an angle "A" to the direction "X." In one configuration of the microphone capsule assembly 200, the angle "A" is 90 degrees and an angle between the directions "X" and "F" is substantially the same as an angle between the directions "F" and "Y" (i.e., the direction "F" bisects an angle formed between the directions "X" and "Y"). In general, the angle formed between the directions "X" and "F" and the angle formed between the directions "F" and "Y" are an acute angles, when measured parallel to the first plane or elevated plane, such as an angle of about 45 degrees. Thus, in some embodiments, the left microphone capsule 206 and the right microphone capsule 208 are co-planar, their front faces are positioned at an angle to each other, and the two microphone capsules operate in a perpendicular orientation to the plane that they share. In one configuration, the left microphone capsule 206 includes a backside 206*b*, which is opposite to the diaphragm 206*a*, that is sealed, and the right microphone capsule 208 includes a backside 208*b*, which is opposite to the diaphragm 208*a*, that is sealed. Due to the elevation, sound signals entering the left microphone capsule 206 and the right microphone capsule 208 do not obstruct sound signals entering the front microphone capsule 202 and rear microphone capsule 204. The elevated plane is separated from the top surface 104*a* of the body 104 by a distance "H" (illustrated in FIG. 2A). The distance "H" is between about 29 mm and 33 mm, such as about 31 mm. In some configurations, the distance "P" between the first plane and elevated plane is between about 15 mm and 25 mm, such as about 19 mm.

The left microphone capsule 206 and the right microphone capsule 208 are spaced from each other within the elevated plane such that sound signals entering the diaphragm 206*a* of the left microphone capsule 206 and the diaphragm 208*a* of the right microphone capsule 206 do not obstruct each other. A distance "$D_{LR}$" between the center of the front face 206*c* of the left microphone capsule 206 and the center of the front face 208*c* of the right microphone capsule 208 is between about 18 mm and about 30 mm, such as about 25 mm. Furthermore, the front faces of the left microphone capsule 206 and the right microphone capsule 208 are offset in the direction "B" from the front face 202*c* of the front microphone capsule 202. The front face 206*c* of the left microphone capsule 206 and the front face 208*c* of the right microphone capsule 208 are offset in the direction "F" from the front face 204*c* of the rear microphone capsule 204. A distance "$D_{FLR}$" between the center of the front face 206*c* of the left microphone capsule 206 or the front face 208*c* of the right microphone capsule 208 and the front face 202*c* of the front microphone capsule 202 is between about 5 mm and about 10 mm, such as about 8 mm.

In some embodiments, the front, rear, left, and right microphone capsules 202, 204, 206, 208 each include or are electrically coupled to a biquadratic-type low-pass filter with adjustable frequency, quality factor (or Q factor), and gain, and a biquadratic-type high-pass filter. The filters allow corrections of any anomalies in responses from the front, rear, left, and right microphone capsules 202, 204, 206, 208.

Figure 3:
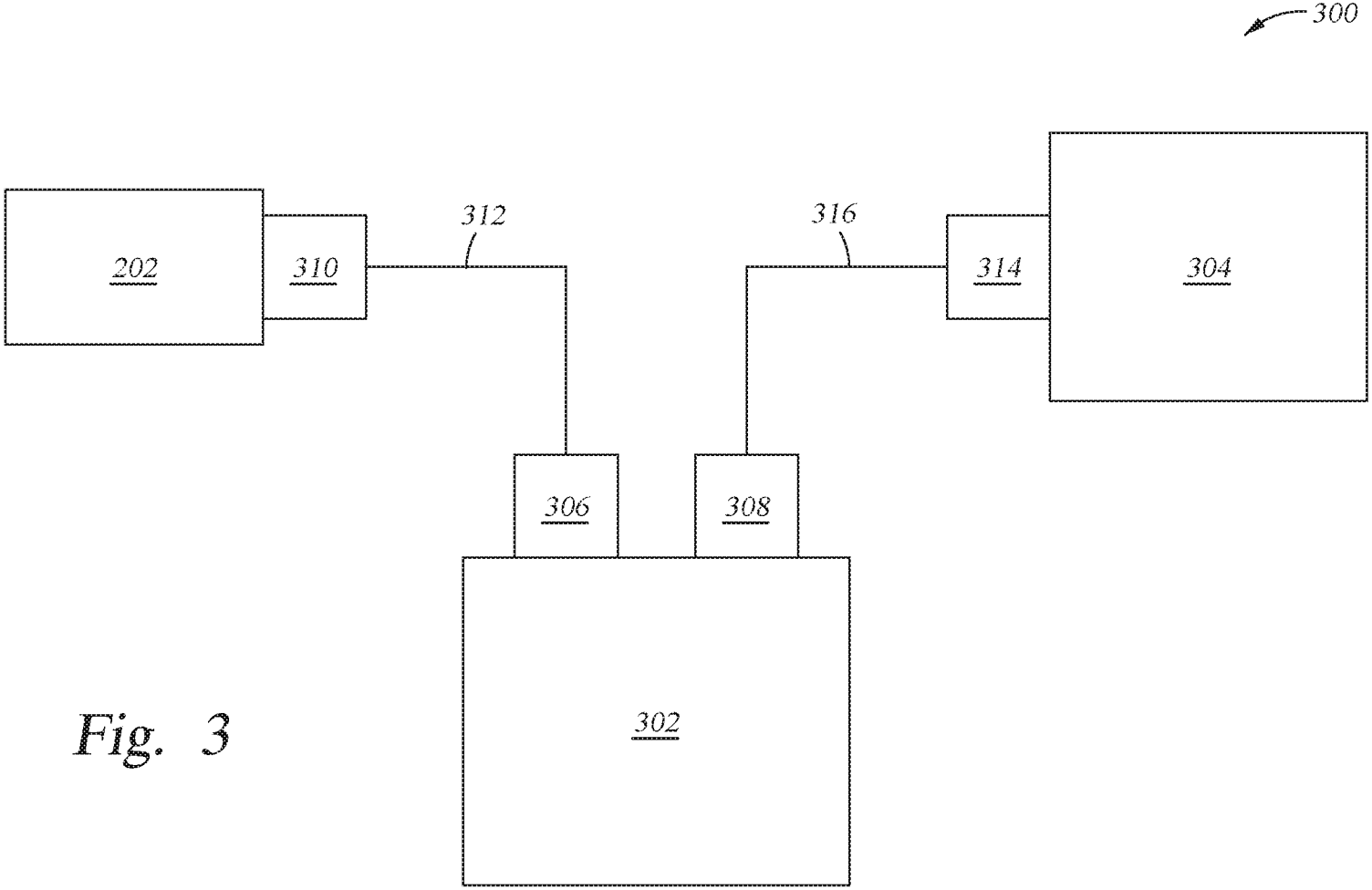
FIG. 3 is a schematic view of a microphone control system 300 according to one embodiment.

FIG. 3 is a schematic view of a microphone control system 300 according to one embodiment. In some embodiments, the microphone control system 300 is housed in the body 104 of the microphone system 100 and connected to the front microphone capsule 202, the rear microphone capsule 204, the left microphone capsule 206, and the right microphone capsule 208. In FIG. 3, only the front microphone capsule 202 is illustrated for ease of explanation. However, the rear, left, and right microphone capsules 204, 206, 208 are similarly connected to the components of the microphone control system 300 as the front microphone capsule 202. The microphone control system 300 includes a controller 302 and a mixer 304. The mixer 304 may be an audio mixer, a recording device, or a preamplifier.

The controller 302 includes connection devices 306 and 308, which is an electrical connection device, such as 3-pin XLRM-type or 3-pin XLRF-type connectors. The front microphone capsule 202 includes a connection device 310, which is an electrical connection device, such as a TA3M-type or TA3F-type connector. The front microphone capsule 202 is connected to the controller 302 via a cable 312 connecting the connection devices 306 and 310. The mixer 304 includes a connection device 314, which is an electrical connection device, such as a 3-pin XLRM-type or 3-pin XLRF-type connector. The mixer 304 is connected to the controller 302 via a cable 316 connecting the connection devices 308 and 314. The mixer 304 may provide phantom power to the microphone capsule assembly 200. In some embodiments, the connection devices 306, 308 310 or 314 may also include a wireless communication device.

The controller 302 includes a memory and a processor coupled to the memory. The memory may include data (e.g., audio data) and one or more applications stored therein. The processor may be any hardware unit or combination of hardware units capable of executing software applications and processing data, including audio data. For example, the processor may be a central processing unit (CPU), a digital signal processor (DSP), an application-specific integrated circuit (ASIC), a combination of such units, or the like. The processor is configured to execute software applications, process audio data, and communicate with I/O devices among other operations.

The memory may be any technically feasible type of hardware unit configured to store data, such as a hard disk, a random access memory (RAM) module, a flash memory unit, or a combination of different hardware units configured to store data. Software application(s) within the memory may include program code (e.g., instructions) that may be executed by the processor in order to perform various functionalities associated with the microphone system 100.

The controller 302 can vary sensitivity to sound signals arriving at the microphone system 100 in certain directions by varying the power level of the front, rear, left, and right microphone capsules 202, 204, 206, 208, varying the output signal levels in the front, rear, left, and right microphone capsules 202, 204, 206, 208, switching polarities of the front, rear, left, and right microphone capsules 202, 204, 206, 208, or switching phases in the front, rear, left, and right microphone capsules 202, 204, 206, 208. The sensitivity to the direction of the an incoming audible signal can be varied by mixing different combinations of the generated audio signals provided from the front, rear, left, and right microphone capsules 202, 204, 206, and 208. The different combinations of the generated audio signals can be adjusted by use of a multi-position electromechanical switch, disposed within the microphone capsule assembly 200, that is configured to be positioned to select one of the many audio signal modes, or audio signal sensing combinations. For example, in a cardioid mode, the microphone system 100 is most sensitive to sound signals that are directly in front of the microphone system 100. In a bidirectional mode, the microphone system 100 is sensitive to both sound signals that are front and back of the microphone system 100. In a stereo mode, the microphone system 100 captures multiple audio sources in front of the microphone system 100. In an omnidirectional mode, the microphone system 100 picks up sound signals equally from all around the microphone system 100.

The controller 302 combines sound signals received by the left and right microphone capsules 206 and 208 when the stereo mode or cardioid mode is selected for capturing sound signals. The controller 302 combines sound signals received by the front and rear microphones 202 and 204 when the bidirectional mode or the omnidirectional mode. The controller 302 also controls the biquadratic-type low-pass and the biquadratic-type high-pass filters of the front, rear, left, and right microphone capsules 202, 204, 206, 208.

Due to variations in the electrical and mechanical characteristics of each microphone capsule due to variations in the manufacturing process, variations in the mechanical or electrical properties of the various components used to form a microphone capsule, and the characteristics of the electrical circuit that the microphone capsule is placed within in the controller 302 the response provided from each microphone capsule to the same incoming audible signal (i.e., sound from a source) can undesirably vary. Therefore, due to the differing response provided from each of the microphone capsules in the microphone capsule assembly 200, an algorithm which is stored in memory of the controller and executed by the processor (e.g., digital signal processor (DSP)) is used to adjust the generated signals created from the audible signals received by the front, rear, left, and right microphone capsules 202, 204, 206, 208 to match their responses over at least a portion of an received input signal range. The adjustment may be used to improve each microphone capsule's response to various known acoustic patterns or typical acoustic input signal characteristics. In some embodiments, the algorithm within the controller 302 is able utilize a low-pass and a high pass filter (e.g., biquadratic-type low-pass and the biquadratic-type high-pass filters) and the ability to adjust the gain levels of the front, rear, left, and right microphone capsules 202, 204, 206, 208 to improve performance and output of the microphone system 100. In particular, overall sensitivity to sound sources, bass roll-off (i.e., attenuation of low frequency response), and high-frequency response are improved by the use of digital signal processing, thus leading to low-cost and high-yield production of microphone systems with high performance and constant output when the digital signal processor is embedded in each microphone system. Therefore, in some embodiments the controller 302 is able to control, adjust and combine outputs of the microphone capsules, by at least adjusting their gain, bass roll-off and high frequency response to achieve an overall microphone system that has improved performance characteristics. A tested and proven set of performance enhancing adjustments for a specific configuration of microphone capsules, or for the correction of common undesirable attributes of a typical population of microphone capsules, can be burned into the system (e.g., stored within the algorithm stored in memory) at the end of the microphone system production line to dramatically reduce variability from one microphone system 100 to the next, to achieve higher system performance, and a consistent device signal output. The use of the algorithm and associated hardware components will allow less expensive capsules to be used in a microphone system with also a minimal need for sorting to find useable microphone capsules, or usable microphone capsules that can used together, thus improving manufacturing yield and reducing the overall manufacturing cost. Typically, in conventional microphone system designs and microphone system production lines, more expensive and higher quality capsules are used and/or the capsules are individually electrically and physically inspected to assure that they meet strict tolerances to assure that a desired performance is achieved in the final microphone system, thus leading to a high initial cost, an often high microphone scrap rate and a higher overall system cost.

While the foregoing is directed to embodiments of the present disclosure, other and further embodiments of the disclosure may be devised without departing from the basic scope thereof, and the scope thereof is determined by the claims that follow.

What is claimed is:

1. A microphone capsule assembly, comprising:

a first microphone capsule oriented to face a first direction that is parallel to a first plane;

a second microphone capsule oriented to face in a direction opposite to the first direction, wherein a front face of the second microphone capsule is spaced a distance from a front face of the first microphone capsule in the first direction;

a third microphone capsule oriented to face in a second direction that is at a first acute angle to the first direction when measured parallel to the first plane; and a fourth microphone capsule oriented to face in a third direction that is at a second acute angle to the first direction when measured parallel to the first plane, wherein the third and fourth microphone capsules are spaced a distance from the front face of the first microphone capsule in the first direction, and wherein the first and second microphone capsules are disposed on the first plane, and the third and fourth microphone capsules are disposed on a second plane that is spaced a distance from the first plane.

2. The microphone capsule assembly of claim 1, wherein the second direction is perpendicular to the third direction, and the first direction bisects an angle formed between the second and third directions.

3. The microphone capsule assembly of claim 1, wherein the first, second, third, and fourth microphone capsules are cardioid capsules.

4. The microphone capsule assembly of claim 1, wherein the first, third and fourth microphone capsules are coupled together.

5. The microphone capsule assembly of claim 1, wherein the first acute angle and the second acute angle are about 45 degrees.

6. The microphone capsule assembly of claim 1, wherein a distance between the first plane and the second plane is between about between about 15 mm and 25 mm.

7. The microphone capsule assembly of claim 1, wherein an angle formed between the second direction and the third direction is about 90 degrees when measured parallel to the first plane.

8. The microphone capsule assembly of claim 7, wherein the first acute angle and the second acute angle are about 45 degrees.

9. The microphone capsule assembly of claim 1, wherein the distance between the front face of the second microphone capsule and the front face of the first microphone capsule is between about 30 mm and about 40 mm.

10. The microphone capsule assembly of claim 1, wherein the distance between the third and fourth microphone capsules and the first microphone capsule is between about 5 mm and about 10 mm when measured from a center of a front face of the third and fourth microphone capsules and the front face of the first microphone capsule.

11. The microphone capsule assembly of claim 1, wherein the first, third and fourth microphone capsules are mounted in a support element that comprises a first material that has a durometer of less than about 30 on a Shore A scale and the second microphone capsule is mounted in another support element that comprises a second material that has a durometer greater than the durometer of the first material.

12. A microphone capsule assembly, comprising:

a first pair of microphone capsules disposed in a first plane;

a second pair of microphone capsules disposed in a second plane that is parallel to and spaced a distance from the first plane, wherein the first pair of microphone capsules comprises:

a first microphone capsule oriented to face in a first direction that is parallel to the first plane; and a second microphone capsule oriented to face in a direction that is opposite to the first direction, and a front face of the second microphone capsule is spaced a distance from a front face of the first microphone capsule in the first direction, the second pair of microphone capsules comprises:

a third microphone capsule oriented to face in a second direction that is at a first acute angle to the first direction when measured parallel to the second plane; and a fourth microphone capsule spaced a distance from the third microphone capsule in the second plane and oriented to face in a third direction that is at a second acute angle when measured parallel to the second plane and perpendicular to the second direction, the first direction bisects an angle formed between the second and third directions, and the first, third and fourth microphone capsules are mounted in a first support element and the second microphone capsule is mounted in a second support element.

13. The microphone capsule assembly of claim 12, wherein the first, third and fourth microphone capsules are coupled together.

14. The microphone capsule assembly of claim 12, wherein an angle formed between the second direction and the third direction is about 90 degrees when measured parallel to the first plane.

15. The microphone capsule assembly of claim 14, wherein the first acute angle and the second acute angle are about 45 degrees.

16. The microphone capsule assembly of claim 12, wherein the distance between the front face of the second microphone capsule and the front face of the first microphone capsule is between about 30 mm and about 40 mm.

17. The microphone capsule assembly of claim 12, wherein a distance between a center of a front face of the third and fourth microphone capsules and the front face of the first microphone capsule is between about 5 mm and about 10 mm.

18. The microphone capsule assembly of claim 12, wherein the first support element comprises a first material that has a durometer of less than about 30 on a Shore A scale and the second support element comprises a second material that has a durometer greater than the durometer of the first material.

19. A microphone capsule assembly, comprising:

a first microphone capsule disposed on a first plane; and a second microphone capsule disposed on the first plane, wherein the first microphone capsule is oriented to face in a first direction that is at a first acute angle to a second direction and away from the second microphone capsule when measured parallel to the first plane, and the second microphone capsule is oriented to face in a third direction that is at a second acute angle to the second direction and away from the first microphone capsule when measured parallel to the first plane.

20. The microphone capsule assembly of claim 19, wherein the first direction is perpendicular to the third direction, and the second direction bisects an angle formed between the first and third directions.

21. The microphone capsule assembly of claim 19, further comprising:

a third microphone capsule disposed on a second plane and oriented to face in the second direction, wherein the second plane is spaced a distance from the first plane in a fourth direction that is perpendicular to the first plane.

* * * * *